US005669344A

United States Patent [19]

Regueiro

[11] Patent Number: 5,669,344

[45] Date of Patent: Sep. 23, 1997

[54] SOHC SYSTEM WITH RADIAL VALVES

[75] Inventor: Jose F. Regueiro, Rochester Hills, Mich.

[73] Assignee: Chrysler Corporation, Auburn Hills, Mich.

[21] Appl. No.: 694,720

[22] Filed: Aug. 9, 1996

[51] Int. Cl.[6] ..... F01L 1/26

[52] U.S. Cl. ..... 123/90.22; 123/90.27; 123/90.4

[58] Field of Search ..... 123/90.22, 90.23, 123/90.27, 90.39, 90.4, 90.41, 90.44

[56] References Cited

U.S. PATENT DOCUMENTS

| | | | |
|---|---|---|---|
| 4,558,667 | 12/1985 | Inagaki et al. | 123/90.44 |
| 4,617,881 | 10/1986 | Aoi et al. | 123/90.27 |
| 4,686,945 | 8/1987 | Inagaki et al. | 123/90.22 |
| 4,850,311 | 7/1989 | Sohn | 123/90.18 |
| 5,080,057 | 1/1992 | Batzill et al. | 123/193 H |
| 5,095,858 | 3/1992 | Ascaru | 123/90.27 |
| 5,150,672 | 9/1992 | Fischer et al. | 123/90.27 |
| 5,211,143 | 5/1993 | Fontichiaro et al. | 123/90.18 |
| 5,241,928 | 9/1993 | Hamada et al. | 123/90.23 |
| 5,303,680 | 4/1994 | Nielsen | 123/90.22 |
| 5,347,964 | 9/1994 | Regueiro | 123/90.22 |
| 5,501,187 | 3/1996 | Speil et al. | 123/90.22 |
| 5,535,710 | 7/1996 | Zoschke et al. | 123/90.27 |
| 5,542,315 | 8/1996 | Carroll, III et al. | 123/90.48 |
| 5,570,665 | 11/1996 | Regueiro | 123/90.27 |

*Primary Examiner*—Weilun Lo
*Attorney, Agent, or Firm*—Kenneth H. MacLean

[57] ABSTRACT

A valve train mechanism for a multi-valve internal combustion engine having hemispherical combustion chambers and in which each chamber has a pair of radial exhaust valves located along one side of the longitudinal axis of the engine and has a pair of radial intake valves located along the other side of the aforementioned longitudinal axis and in which an inverted "L" shaped actuator is provided for actuating each of the exhaust and intake valves and the guide pins supporting the actuators associated with at least one pair of same-function valves are positioned relative to the valves so as to cause the actuators to reciprocate along and oscillate about the associated guide pins while the associated pair of same-function valves are moved between an open position and a closed position.

10 Claims, 6 Drawing Sheets

SOHC SYSTEM WITH RADIAL VALVES

FIELD OF THE INVENTION

This invention concerns internal combustion engines and, more particularly, relates to a single actuator system combined with radial or angulated intake valves and exhaust valves extending from a curved upper wall of the combustion chamber and in which each of the valves is operated through a rocker arm and an actuator system having inverted "U" shaped actuators.

BACKGROUND OF THE INVENTION

My copending patent application U.S. Ser. No. 08/629,161 entitled "Valve Train For An Internal Combustion Engine", filed on Apr. 8, 1996, discloses a valve train mechanism which serves to directly actuate radially disposed engine valves driven by an inverted bucket tappet through a spherical joint without any side thrust on the valve stem. Moreover, the mechanism shown in this patent application is designed to operate either one single valve per rocker arm or two. When two valves are operated, it is done by the use of a crosshead which can be guided or unguided. These mechanisms allow the valves to be operated without side thrust on the valve stem, and to do so they require inverted bucket tappets. In addition, these mechanisms combine sliding and rotating motions between the actuator, be it a finger follower, a rocker arm or cross member, and the inverted bucket tappet. In cases where rotating motion exits, it is provided by using spherical joints which take the form of a half-ball, a full ball or an encapsulated half-ball which at times is referred to as "an elephant foot". The sliding motion can be provided by a shoe associated with the ball portion of the spherical joint. As an alternative, the half-ball can have the flat surface thereof serve to provide the sliding connection with the actuator. All of the sliding motions have large surface areas between the contact members so as to minimize wear. Accordingly, high-wear "single point" or "line" contacts are eliminated.

These mechanisms are particularly useful on engines in which the two sets of same-function valves (intake or exhaust) are disposed transversely to the engine centerline. This is the preferred disposition of the valves when swirl air flow is desired for combustion purposes because the port disposition enhances the swirling motion. Valve arrangements of this sort have been used for over thirty years on engines with conventional cylinder head layouts in which the valves are disposed with their stems in parallel to each other and to the axial centerline of the cylinder. Due to the fact that the maximum valve sizes achievable as well as the tortuous ports connecting them and opening to the outside of the engine are limited, the maximum air flow that the engine can process is rather limited. With the limited air flow and the relatively low injection pressures that have been used in the past, the necessary rapid mixing process of the fuel and air has not been easy to achieve. In order to avoid the slow combustion which results from such poor mixing process, swirl has been used to improve the mixing and combustion. (Swirl is defined as rapid rotational motion of the air about the axis of the cylinder). In more recent times, higher injection pressures have become available through more modern injection systems. Accordingly, the need for swirl has been reduced even with conventional four-valve engines. Since swirl is achieved by converting air pressure into air velocity, reducing it has increased the flow and the power output of the engine. For example, the new Detroit Diesel Corporation Series 60 engine with a 130 mm bore diameter realizes very good combustion by eliminating the swirl, increasing the air flow, and using extremely high injection pressures. The exchange of swirl for air flow has been obtained by placing the two sets of same-function valves side-by-side along each side of the engine rather than transversely as typically used in the smaller, high-speed truck engines. With the large increase in valve sizes and air flow provided by the radial disposition of the valves in the cylinder head, it is now possible to dispose of the swirl altogether and place the valves side-by-side in combination with short, direct, high-efficiency ports. Whereas on the larger engines, such as the above-mentioned Detroit Diesel engine, it is possible to use a valve train mechanism with longitudinally disposed conventional crossheads and parallel stems, on smaller engines it is impossible, as a practical matter, to downsize the mechanisms in a proportional scale because some of the components and critical dimensions cannot be scaled downward. For example, the mechanism would require extremely long and heavy rocker arms and a camshaft placed at a very large distance from the center of the cylinder, resulting in a very wide and heavy cylinder head. Therefore, if side-by-side ports are desired with all the inlets on one side of the engine and all the exhausts on the other side while utilizing radial valves, a new valve train mechanism is required.

SUMMARY OF THE INVENTION

In this regard, the present invention disclosed in this patent specification provides such a new valve train mechanism. Moreover, the present invention has certain similarities to the valve train mechanism described in the above-mentioned patent application in that it utilizes spherical joints combined with actuators for operating radial exhaust valves and intake valves of an internal combustion engine. However, this invention differs structurally from the above-described valve train mechanism in that each of the valves is operated through a rocker arm and a piloted actuator supported by a guide pin. The actuator takes the form of an inverted "L" and comprises a leg portion and an arm portion. The leg portion is carried by the guide pin for reciprocating movement while the arm portion is connected to and maintains a force-applying connection with an inverted bucket tappet through a combined spherical joint and sliding connection. The latter mentioned connection as well as the design of the actuator allows the supporting guide pin to be positioned relative to the exhaust and intake valves at points which can permit the actuator not only to reciprocate along the guide pin but also simultaneously experience oscillation about the guide pin. Thus, by providing the actuator with the ability to have compound movement, an engine designer can have a great amount of flexibility in designing a valve train and port system for a multi-valve internal combustion engine and provide an optimum central location of the fuel injector or spark plug.

Accordingly, one object of the present invention is to provide a new and improved actuator system for a valve train mechanism forming a part of an internal combustion engine and in which the actuator system is characterized in that individual inverted "L" shaped actuators are utilized for operating each of the exhaust valves and each of the intake valves.

Another object of the present invention is to provide a new and improved valve train mechanism for an internal combustion engine that includes individual inverted "U" shaped actuators for each of the exhaust valves and each of the intake valves and in which each of the actuators is supported on a guide pin which allows the actuator to reciprocate along an axis parallel to the longitudinal center axis of the associated cylinder as the associated valve moves between the open and closed position.

A further object of the present invention is to provide a new and improved actuator system for a valve train mechanism including angulated exhaust valves and intake valves incorporated in an internal combustion engine and in which the actuator system has an inverted "L" shaped actuator provided for each of the exhaust valves and each of the intake valves and each actuator is connected to its associated valve through a combined spherical joint and a sliding connection.

A still further object of the present invention is to provide a new and improved actuator system for a valve train mechanism which forms a part of an internal combustion engine and in which the actuator system has an independent actuator provided for each of the exhaust valves and each of the intake valves and in which the actuator is capable of reciprocating along an axis parallel to the longitudinal center axis of the associated cylinder and is also capable of oscillating about the same axis during movement of the associated valve between a closed position and an open position.

A still further object of the present invention is to provide a new and improved valve train mechanism for a multi-valve internal combustion engine in which each cylinder of the engine has at least a pair of angulated exhaust valves located along one side of the engine and a pair of angulated intake valves located along the other side of the engine and in which individual "L" shaped actuators are provided for actuating each of the intake valves and each of the exhaust valves.

A still further object of the present invention is to provide a new and improved valve train mechanism for a multi-valve internal combustion engine having hemispherical combustion chambers and in which each chamber has at least a pair of radial exhaust valves located along one side of the longitudinal axis of the engine and has a pair of radial intake valves located along the other side of the aforementioned longitudinal axis and in which an inverted "L" shaped actuator is provided for actuating each of the exhaust and intake valves, and in which the guide pins supporting the actuators associated with at least one pair of same-function valves are positioned relative to the valves so as to cause the actuators to reciprocate along and oscillate about the associated guide pins while the associated pair of same-function valves are moved between an open position and a closed position.

BRIEF DESCRIPTION OF THE DRAWINGS

Other objects, advantages and features of the present invention will be apparent from a reading of the following detailed description when taken with the drawings in which.

DETAILED DESCRIPTION OF THE DRAWINGS

Figure 1:
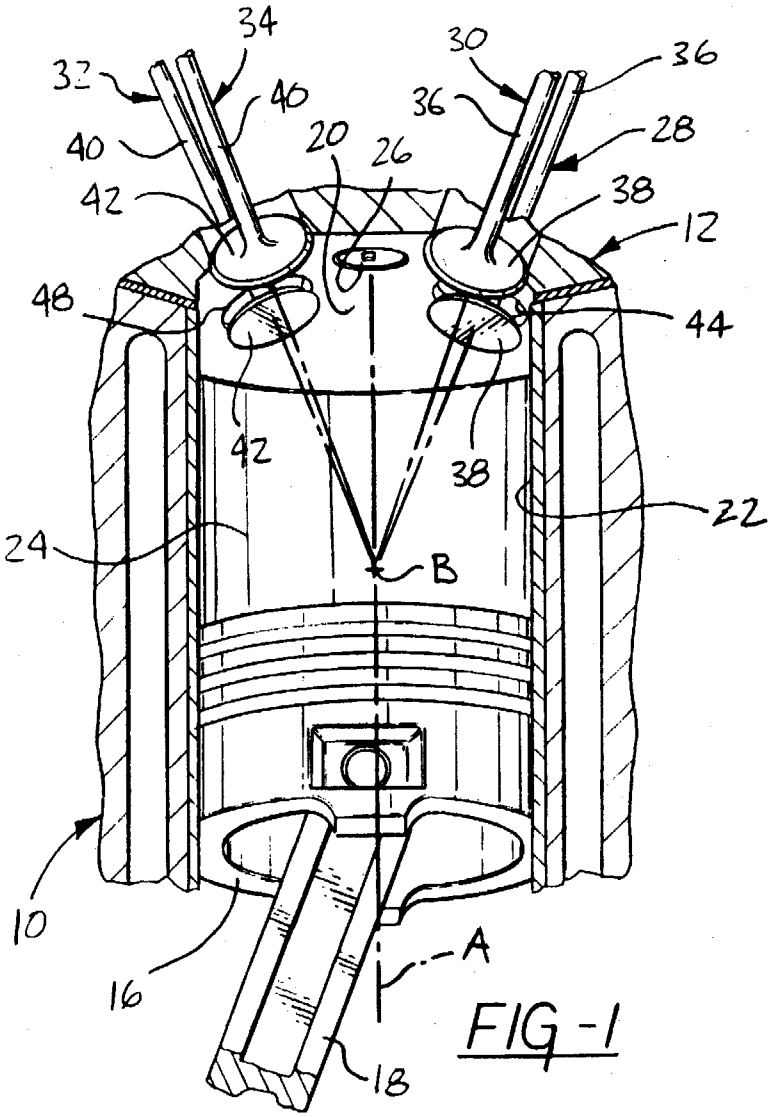
FIG. 1 is a perspective view of one cylinder of a multi-cylinder engine showing a pair of intake valves and a pair of exhaust valves actuated through an actuator system incorporated within a valve train mechanism according to the present invention and seen in FIG. 2.

Referring now to the drawings and more particularly to FIG. 1 thereof, a perspective view of a single cylinder of a multi-cylinder engine is shown having an engine block 10 on which is secured by fasteners (not shown) a lower head portion of a two-piece cylinder head assembly 12. The cylinder head assembly 12 serves to support a valve train mechanism 14 which includes an actuator system 15 in accordance with the present invention and seen in FIG. 2.

Figure 3:
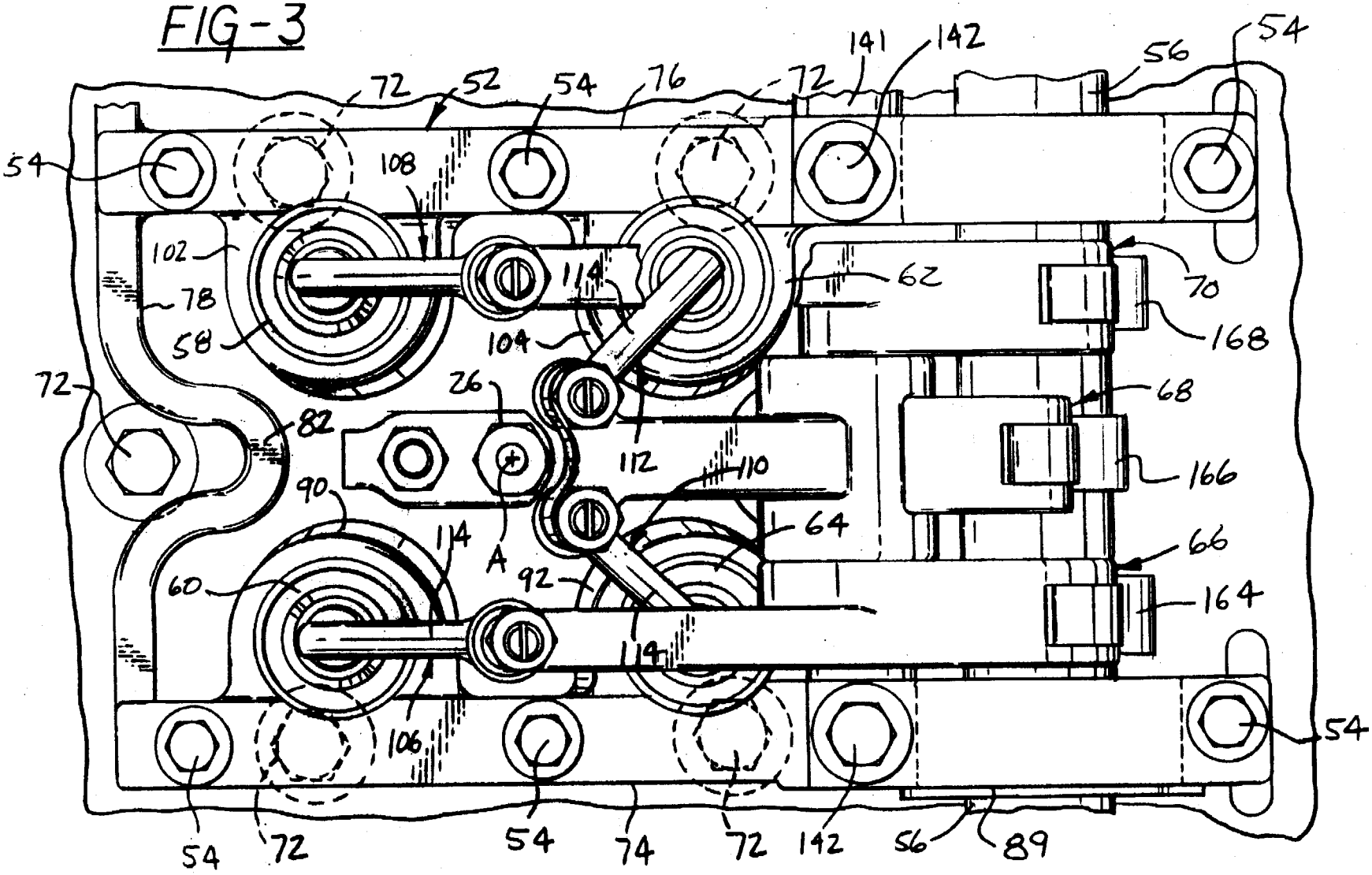
FIG. 3 is a plan view of the valve train mechanism seen in FIG. 2.

Each of the cylinders of the engine houses a piston 16 which moves axially along the longitudinal center axis A of the associated cylinder and has the lower end thereof connected to the engine crankshaft (not shown) by a connecting rod 18. The lower base portion 19 of the cylinder head assembly 12 is formed with a hemispherical surface 20 providing a recess which is aligned with the bore defining the associated cylinder 22 and together with the top of the piston 16 forms a combustion chamber 24 which varies in volume during the operation of the engine. In this instance, a diesel fuel injector 26 seen in FIG. 3 is secured in the cylinder head 12 centrally of the hemispherical surface or recess 20 along the longitudinal axis "A" of each cylinder 22. The fuel injector 26 is secured in position by a clamp and a nut tightened on a stud threadably secured to the lower base portion 19 of the cylinder head 12. As will become apparent as the description of the present invention proceeds, the actuator system 15 forming a part of the valve train mechanism 14 according to the present invention can also be used with a spark ignition internal combustion engine in which case a spark plug would be substituted for the injector 26.

Figure 2:
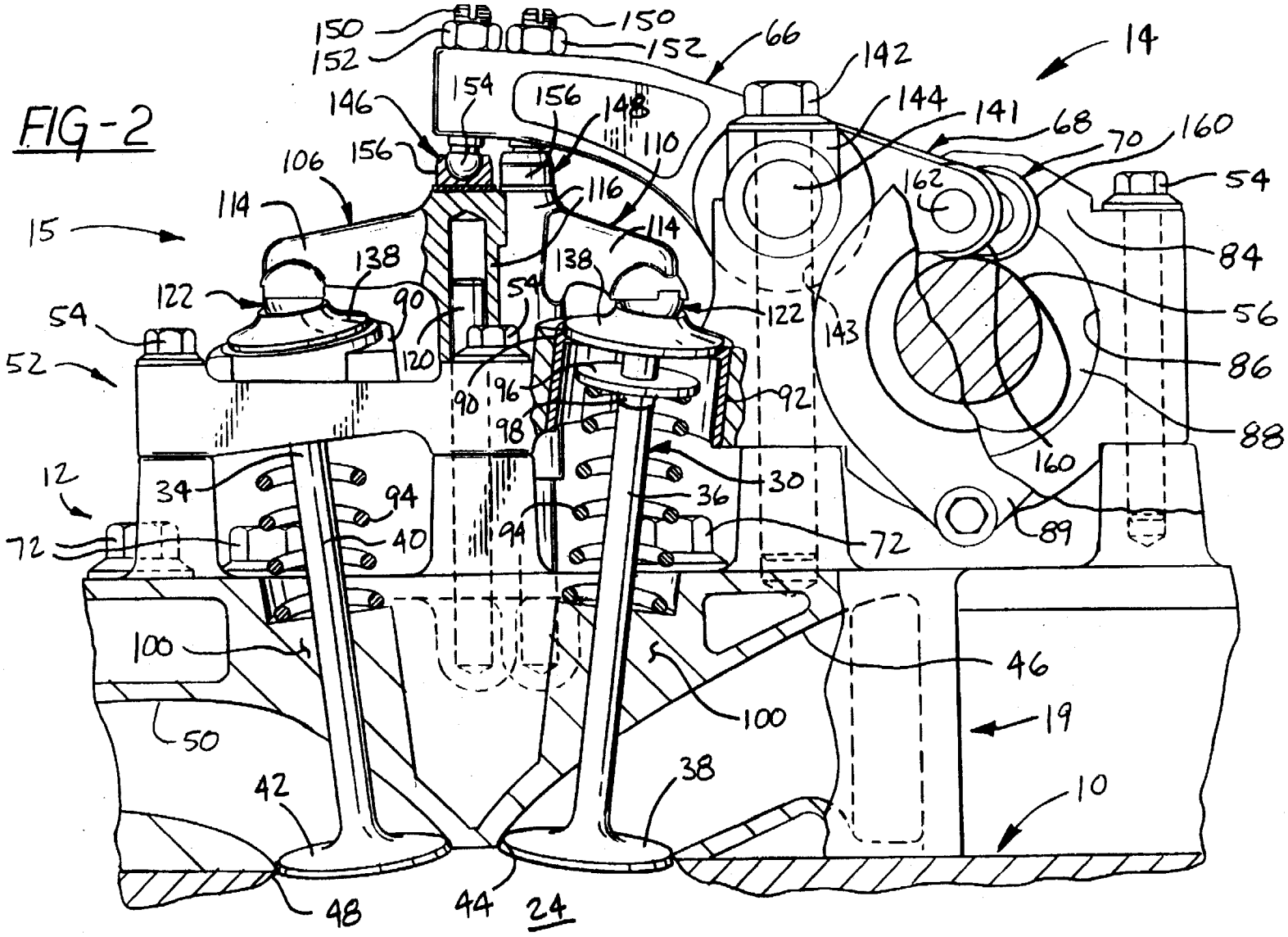
FIG. 2 is a view partially in section of a portion of the cylinder head showing one of the exhaust valves and one of the intake valves of FIG. 1 and one embodiment of an actuator system employed by a valve train mechanism for actuating the valves in accordance with the present invention.

As best seen in FIGS. 1 and 2, the cylinder head assembly 12 is provided with a pair of intake valves 28 and 30 and a pair of exhaust valves 32 and 34 which are located in side-by-side relationship extending along the longitudinal axis of the engine. Each of the intake valves 28 and 30 has a valve stem 36 the lower end of which is formed with a round valve head 38. Similarly, each of the exhaust valves 32 and 34 has a valve stem 40 the lower end of which is formed with a round valve head 42. As is conventional, each of the intake valve heads 38 is normally seated in a valve seat formed in the cylinder head that defines a round opening or port 44 of an intake passage 46 formed in the lower base portion 19 of the cylinder head assembly 12 as seen in FIG. 2. Also, each of the exhaust valve heads 42 are normally seated in a valve seat formed in the cylinder head 12 that defines a round opening or port 48 of an exhaust passage 50 also formed in the lower base portion 19 of the cylinder head assembly 12.

It will be noted that the valve stems 36 of the intake valves 28 and 30 and the valve stems 40 of the exhaust valves 32 and 34 are disposed radially or angularly about the cylinder head 12 such that the intersection of their longitudinal center axes occurs at a point "B" located on the longitudinal center axis "A" of the cylinder 22 as seen in FIG. 1. As a result, the centers of the valve heads 38 of the intake valves 28 and 30 and the centers of the valve heads 40 of the exhaust valves 32 and 34 are located on a common circle concentric with the periphery of the cylinder 22. In addition, in this case, the centers of the valve heads 38 and 42 are circumferentially equally spaced from each other. Also, each of the valve heads 38 and 42 is in an essentially tangential plane relative to the hemispherical recess 20. Thus, as seen in FIG. 1, the longitudinal centerline of each valve 28–34 is canted at an equal angle to both the longitudinal and transversal planes of the engine. This orientation not only allows for more room at the top of the cylinder 22 and lessensthe space requirements for valves, spark plugs, injectors, pre-combustion chambers or cooling water jackets, but also produces a far superior combustion chamber with optimum central location of the spark plug or injector. It will be understood that for practical considerations the valves 28–34 may be disposed with different angles on longitudinal and transversal planes so that the point "B" may not fall on the longitudinal center axis "A".

Referring again to FIG. 2, it will be noted that this figure is an elevational sectional view of the cylinder head 12 taken along a plane extending transversely of the engine and shows the exhaust valve 34 and the intake valve 30 seen in FIG. 1 and the actuator system 15 employed by a valve train mechanism 14 for actuating the valves in accordance with the present invention. Inasmuch as the engine block 10 and the various operating components normally associated therewith are well known to those skilled in the art of engine design, a detailed showing and/or description of such parts and components is not being provided herein. Instead, the valve train mechanism 14 and the parts associated therewith will be described below in detail. In addition, it will be noted that in describing the structure of the cylinder head assembly 12 and the valve train mechanism 14, only the parts associated with one cylinder of the engine block 10 will be described in detail and it will be understood that similar and identical parts are associated with each of the other cylinders of the engine block 10.

As seen in FIGS. 2–5, the cylinder head assembly 12 includes the lower base portion 19 which is generally rectilinear and preferably made of cast iron. The cylinder head assembly 12 also includes a tappet and camshaft carrier 52, preferably made in aluminum alloy, is secured to the base portion 19 by a plurality of bolts 54 and 142 and serves to support a camshaft 56, inverted bucket tappets 58, 60, 62, 64 for each valve, and rocker arms 66, 68 and 70 as will be more fully explained hereinafter, for each cylinder. The base portion 19, in turn, is fastened to the upper end of the engine block 10 by a plurality of head bolts 72 which extend through the body of the base portion 19 into threaded holes (not shown) formed in the engine block 10. Although not shown, a pair of laterally spaced and parallel side walls may be integrally formed with the base portion 19 and extend upwardly and, together with a valve cover (not shown) plus corresponding front and back walls, serve to enclose the carrier 52 and the valve train mechanism 14. As seen in FIG. 2, the air intake passage 46 and the exhaust passage 50 are provided in the base portion 19 and terminate respectively at the ports 44 and 48 which, in turn, communicate with the combustion chamber 24.

As best seen in FIGS. 3 through 6, the carrier 52 for one cylinder of the engine is formed by fore and aft spaced bulkheads 74 and 76. The bulkheads 74 and 76 are interconnected by a pair of laterally spaced expansion bars 78 and 80 each of which has the midsection thereof formed with a "U" shaped loop portion 82. Each of the bars 78 and 80 are of relatively thin uniform cross section and are designed to flex in a limited region of stress and strain so that they act as an elastic portion of the carrier 52 to compensate for the differential rate of thermal expansion between the aluminum alloy of the carrier 52 and the iron base portion 19 of the cylinder head assembly 12.

Figure 6:
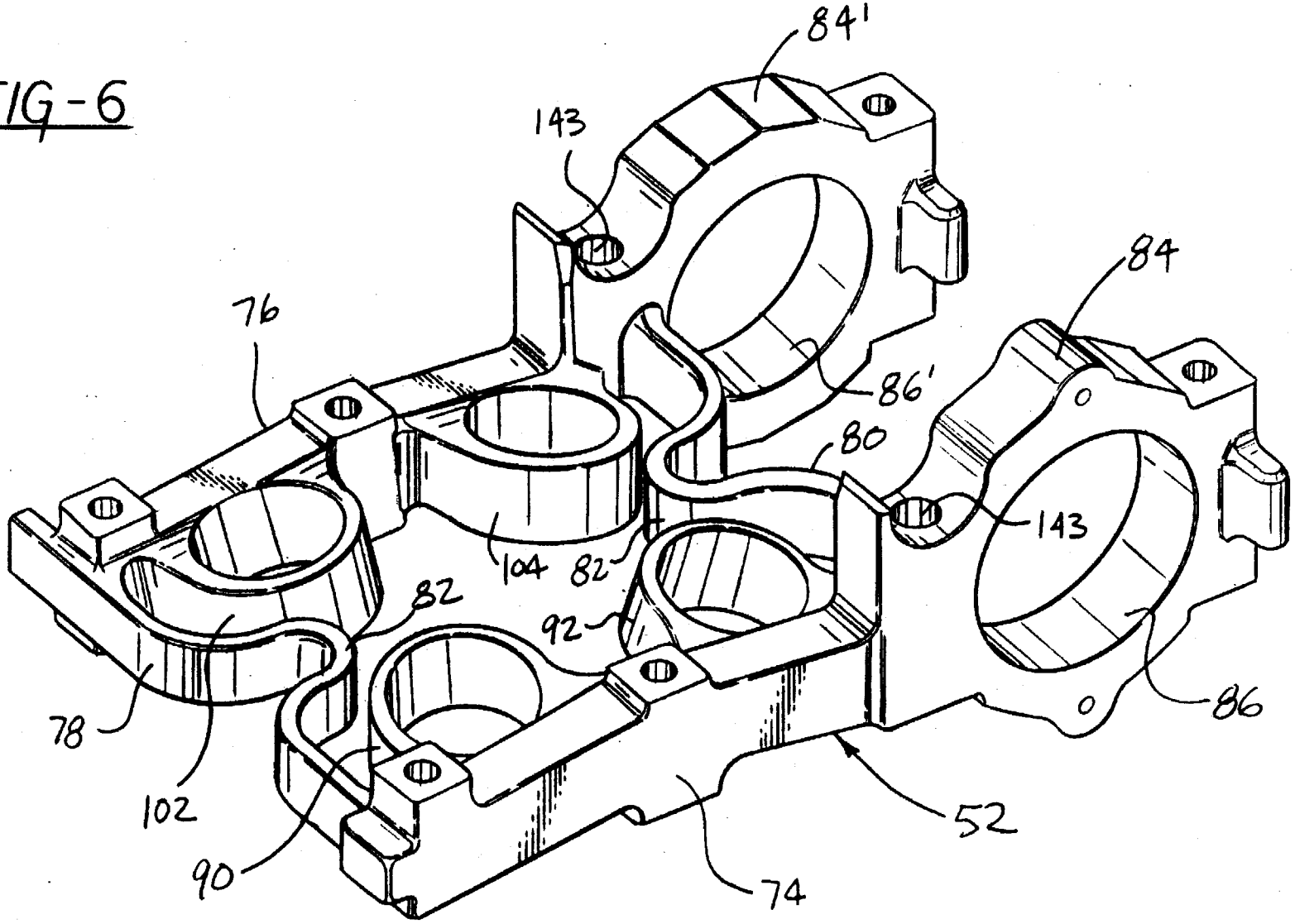
FIG. 6 is a perspective view of the carrier which supports the tappets, camshaft and the rocker shaft for the rocker arms forming a part of the valve train mechanism.

Each of the bulkheads 74 and 76 is integrally formed with a ring-shaped bearing portion 84 at one end thereof which is provided with a cylindrical opening 86 in which the journal portion 88 of the camshaft 56 is supported for rotation. As seen in FIG. 6, it will be noted that the cylindrical opening 86' in the bearing portion 84' of the bulkhead 76 has a smaller diameter than the cylindrical opening 86 of the bulkhead 74. Similarly, the journals 88 of the camshaft which are located in the cylindrical openings 86, 86' of the bulkheads 74 and 76 will have an outer diameter appropriately sized so that they fit into the accommodating cylindrical openings 86. This allows the camshaft 56 to be readily inserted axially into the cylindrical openings 86 of the carrier 52. The bulkheads (not shown) positioned adjacent the cylinders of the engine 10 to the rear of the bulkhead 76 will also have cylindrical openings which are progressively smaller so as to allow the camshaft 56 to be inserted axially into the bearing portions and retained axially by a thrust plate 89 seen in FIG. 2 in combination with the camshaft gear or sprocket (not shown). This arrangement also facilitates the machining process by using stepped tooling.

The bulkhead 74 is located at the front end of the engine and is integrally formed with a pair of laterally spaced and cylindrically shaped tappet guides 90 and 92. As seen in FIGS. 2 and 3, the tappet guide 90 supports the inverted bucket tappet 60 which is in contact with the upper end of the valve stem 40 of the exhaust valve 34 for movement along the longitudinal center axis of the associated valve stem 40. Similarly, the tappet-guide 92 supports the inverted bucket tappet 64, which is in contact with the upper end of the valve stem 36 of the intake valve 30, for movement along the longitudinal center axis of the associated valve stem 36. Both the exhaust valve 34 and the intake valve 30 are each biased into a closed position by a coil compression spring 94 the upper end of which abuts a retainer 96 secured to the valve stem by a conventional two-piece lock 98. The lower end of each of the springs 94 is located within a spot-faced recess on the top deck of a valve stem guide 100 which is integrally formed with the base portion 19 and supports the associated valve for reciprocal movement.

Figure 4:
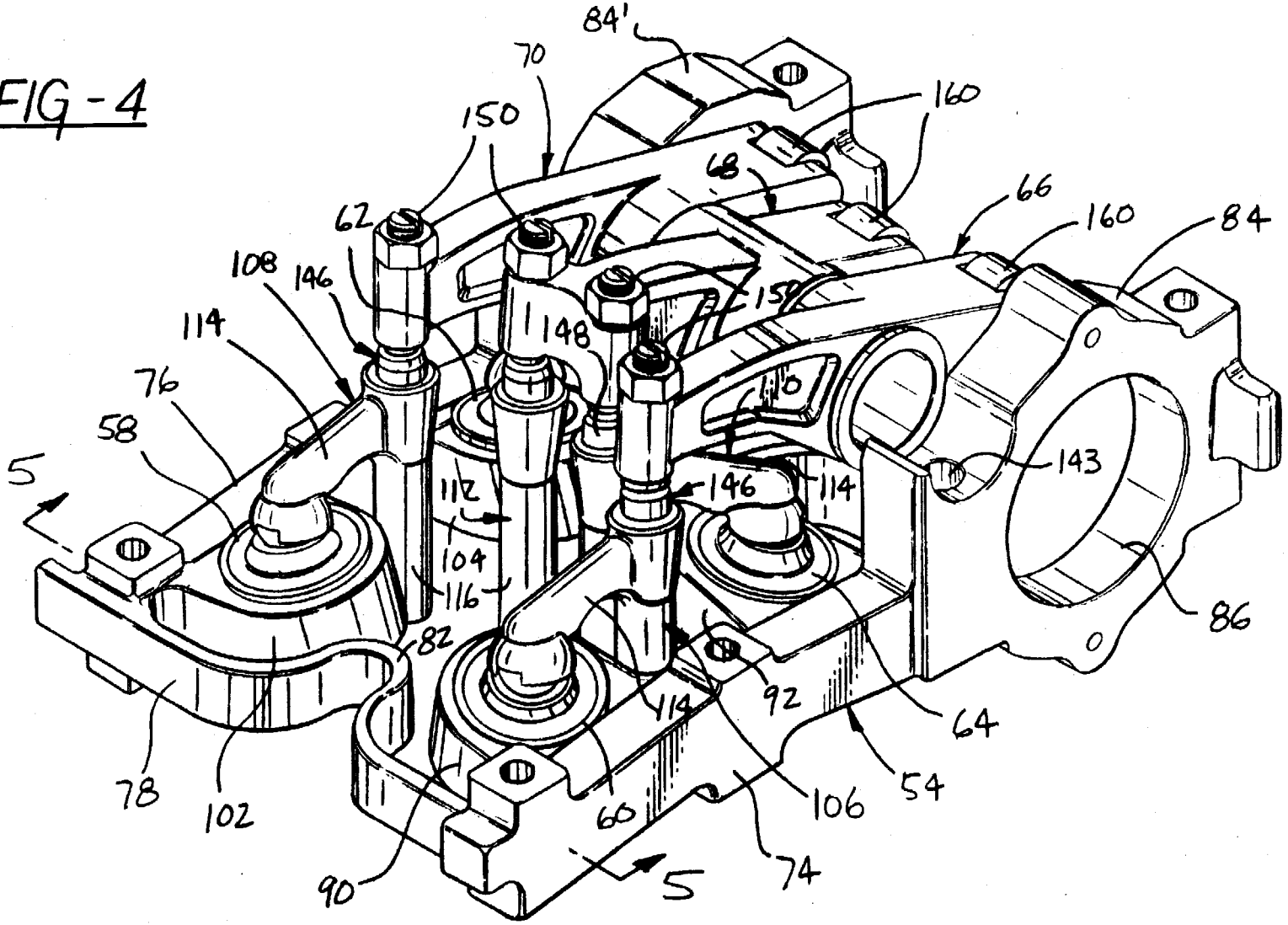
FIG. 4 is a perspective view of the valve train mechanism seen in FIGS. 2 and 3 with certain parts thereof removed so as to simplify the disclosure for clarity purposes.

As seen in FIGS. 3 and 4, the bulk-head 76 is integrally formed with a tappet guide 102 supporting the inverted bucket tappet 58 associated with the exhaust valve 32 for movement along the longitudinal center axis of the associated valve stem 40. In addition, a tappet guide 104 integrally formed with the bulkhead 76 supports the inverted bucket tappet 62 associated with the intake valve 28 for movement along the longitudinal center axis of the associated valve stem 36. Similarly, the exhaust valve 32 and the intake valve 28 are supported in the base portion 19 by parts corresponding to the parts supporting the exhaust valve 34 and intake valve 30 as seen in FIG. 2. In addition, although not shown, it will be understood that the bulkhead 76 has tappet guides such as tappet guides 90 and 92 integrally formed on the side opposite the tappet guides 102 and 104 for the intake and exhaust valves associated with the cylinder to the rear of cylinder 22. Similar bulkheads with two sets of tappet guides would be provided between the other cylinders and the last bulkhead would be a mirror image of the front bulkhead 74.

Figure 7:
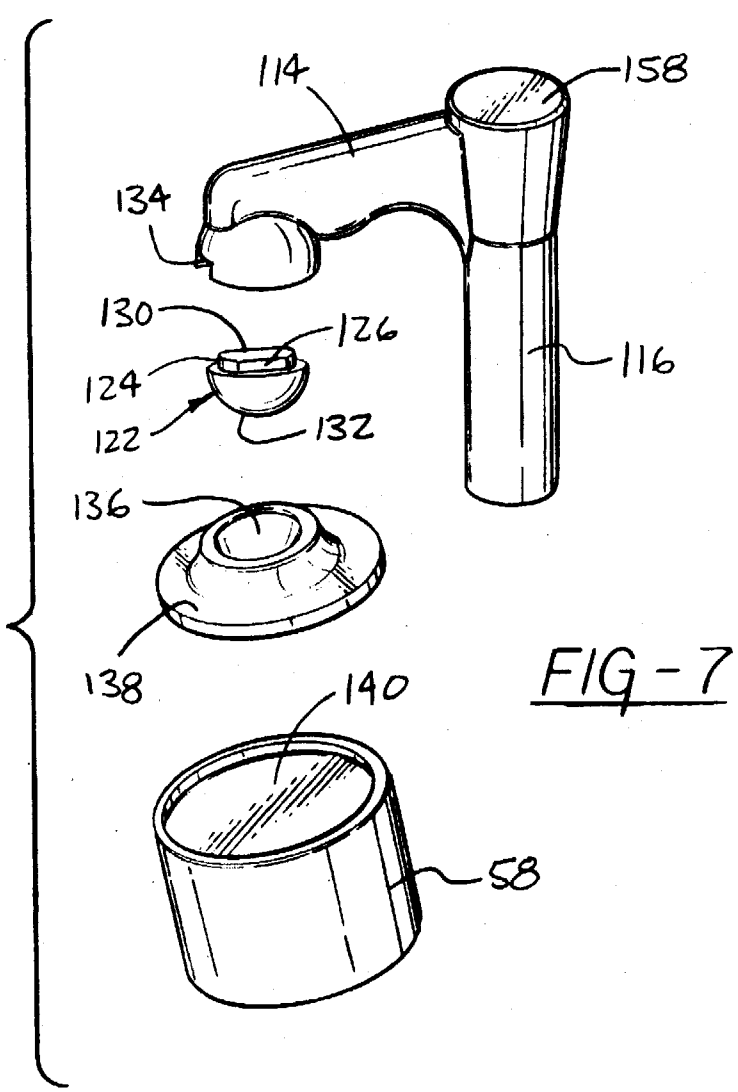
FIG. 7 is an exploded view of one of the actuators forming a part of the valve train mechanism seen in FIGS. 2–5.

As seen in FIGS. 1–5, opening of the exhaust valves 32, 34 and the intake valves 28, 30 against the bias of the associated springs 94 is controlled through the actuator system 15 which in this case, as shown, includes four identical "L" shaped actuators 106, 108, 110, and 112 each of which, as seen in FIG. 7, comprises an arm portion 114 integrally formed with a leg portion 116. The leg portion 116 of each of the actuators 106–112 is provided with a flat top surface 118 and is supported for reciprocal movement by a guide pin 120 the lower end of which is fixed to the top deck of the base portion 19. The longitudinal center axis of each guide pin 120 is positioned parallel to the axis "A" of the cylinder 22.

Figure 5:
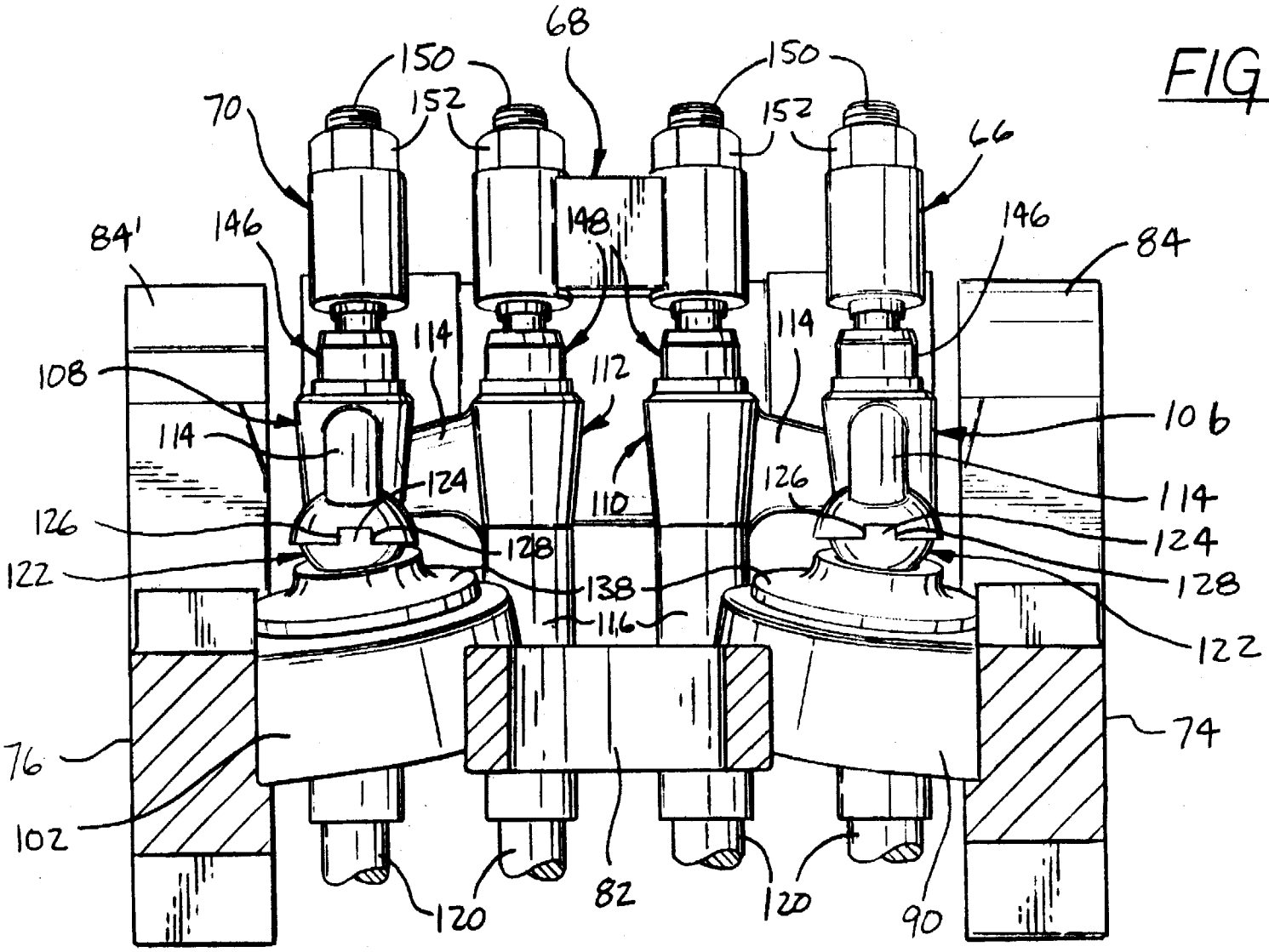
FIG. 5 is a view taken on line 5—5 of FIG. 4.

The head end of each arm portion 114 of the actuators 106–112 is provided with a combination spherical and sliding joint. Thus, as seen in FIG. 4, a combination spherical and sliding joint is positioned between the actuator 106 and the inverted bucket tappet 60, between the actuator 108 and the inverted bucket tappet 58, between the inverted 110 and the inverted bucket tappet 64, and between the actuator 112 and the inverted bucket tappet 62. As seen in FIGS. 5 and 7, the combination spherical and sliding joint, in each instance, is the same in construction and includes a half-ball member 122 having an integral upwardly extending tongue 124 defined by a pair of spaced flat and parallel side walls 126 and 128 and a flat top wall 130 which is located in a plane normal to the associated side walls 126 and 128. The half-ball member 122 also includes a spherical lower surface 132. The top portion of the tongue 124 of the half-ball member 122 is slidably received by a slot 134 formed in the head end of the arm portion 114. The slot 134 is "U" shaped and of uniform cross section and extends along the longitudinal axis of the associated arm portion. The lower spherical surface 132 of the half-ball member 122 is located within a spherical recess 136 centrally formed in a socket member 138 which is formed as a separate disc member centrally positioned within a circular recess 140 in the top of the associated inverted bucket tappet. As an alternative, the socket member 136 can be made integral with the top of the associated inverted bucket tappet.

The actuators 106–112 are operated by the rocker arms 66–70 which are supported for oscillation by a rocker shaft 141 secured to one shoulder of the bearing portion 84 of each of the bulkheads 74 and 76 by a bolt 142 which extends through a cap 144, through the rocker shaft 141, and through the corresponding hole 143 in each bulkhead 74, 76 into a threaded opening (not shown) in the base portion 19. The rocker arms 66 and 70 are mirror images of each other with the tail end portion of each being provided with a spherical joint 146 of the type frequently referred to as an "elephant foot". On the other hand, the rocker arm 68 is somewhat shorter in length than the rocker arms 66 and 70 and has the tail end thereof provided with a dual-end arrangement supporting a pair of spherical joints 148 which are identical in construction to the spherical joint 146 of the rocker arms 66 and 70. In this regard and as seen in FIG. 2, each of the spherical joints 146 and 148 includes an adjusting screw 150 the shank portion of which is threaded into the tail end of the associated rocker arm and is secured thereto by a locknut 152. The lower end of the adjusting screw 150 is integrally formed with a ball portion 154 captured within a spherical recess of a socket member 156 having a flat lower contact surface in relative slidable engagement with the flat top surface 118 of the associated actuator.

Thus, as seen in FIGS. 4 and 5, the spherical joint 146 of the rocker arm 66 rests on the flat top surface 118 of the leg portion 116 of the actuator 106 while the spherical joint 146 of the rocker arm 70 rests on the flat top surface 118 of the leg portion 116 of actuator 108. Also, the two spherical joints 148 of the rocker arm 68 rests on the flat top surface 118 of the actuators 110 and 112. The screws 150 serve to individually set the lash-adjustment for each valve actuating mechanism.

The head-end portion of each rocker arm 66, 68, and 70 is provided with a roller 160 supported for rotation by a shaft 162 fixed to the associated rocker arm. As seen in FIGS. 2 and 3, the rollers 160 of the rocker arms 66, 68, and 70 are in rolling contact with cam lobes 164, 166, and 168, respectively, formed on the overhead camshaft 56. Both the camshaft 56 and the rollers 162 are each supported for rotation about an axis which is substantially parallel to the rotational axis of the engine crankshaft. Also, the longitudinal center axis of the rocker shaft 141 about which the rocker arms 66–70 oscillate is parallel to the rotational axes of the rollers 160 and the camshaft 56.

It will be noted that each of the guide pins 120 associated with the actuators 106–112 and the valves 28–34 are strategically located so as to realize an efficient operation of the valve train mechanism 14 and provide sufficient space for the spark plug in the case of a spark ignition engine and for the fuel injector in the case of a compression ignition engine. Thus, as seen in FIG. 3, the center of the guide pin 120 of the actuator 106 is located along a line interconnecting the center of the half-ball member 122 of the actuator 106 and the center of the half-ball member 122 of the actuator 110. Similarly, the center of the guide pin 120 of the actuator 108 is located along a line interconnecting the center of the half-ball member 122 of the actuator 108 and the center of the half-ball member 122 of the actuator 112. Also, as seen in FIG. 3, the center of the guide pin 120 of the actuator 110 is located along a line interconnecting the center "A" of the cylinder 22 and the center of the half-ball member 122 of the actuator 110. In addition, the center of the guide pin 120 of the actuator 112 is located along a line interconnecting the center axis "A" of the cylinder 22 and the center of the half-ball member 122 of the actuator 112. This "folded back" motion arrangement of the rocker arm 68 and actuators 110, 112 allows the proper rocker arm ratio and physical disposition of all of the valve train components including the injector within the limited space provided for each cylinder over the cylinder head.

Accordingly, with the guide pins 120 of the actuators 106–112 being positioned as described above, and as the camshaft 56 rotates in timed sequence to the associated engine crankshaft, the tail end of the rocker arms 66 and 70 will be pivoted downwardly as seen in FIG. 2 when the rollers 160 are contacted by the lift portions of the cam lobes 164 and 168 to open the exhaust valves 32 and 34 and provide communication between the combustion chamber 24 and the exhaust passage 50. Inasmuch as the center of the tappet moves radially towards the center of the cylinder, the tail end of each of the rocker arms 66 and 70 moves along an arc while each of the associated actuators 106 and 108 (under the urging of the rocker arms 66 and 70) moves downwardly along a straight line defined by the longitudinal center axis of the guide pin 120. During this motion, the socket member 156 of the spherical joint 146 of each rocker arm 66 and 70 will slide in the transversal plane relative to the associated actuator. At the same time, as the actuators 106 and 108 are moved downwardly by the rocker arms 66 and 70, the combination spherical joint and sliding connection between each of the actuators 106, 108 and the associated inverted bucket tappets 58, 60 serves to compensate for the skewed movement of the tappets towards point "B" as seen in FIG. 1. Since each of the inverted bucket tappets 58, 60 experiences a compound movement during this time, the associated actuator also experiences a compound movement due to the position of the guide pin 120. In other words, each of the actuators 106 and 108 not only moves in a downward direction along the associated guide pin 120 but, in addition, the arm portion 114 of each of the actuators 106 and 108 pivots about the associated guide pin 120 as indicated by the arrows in FIG. 3. This movement occurs because, as seen in FIG. 3, each inverted bucket tappet 58 and 60 moves downwardly along the longitudinal axis of the associated valve stem, so it also moves towards the center axis "A". This movement, in turn, causes the half-ball member 122 to slide within the slot 134 relative to the associated arm portion 114 in a direction towards the guide pin 120 of the associated actuator while the latter pivots about the guide pin 120. At the same time, the half ball member 122 within the accommodating spherical recess 136 compensates for the movement of the associated inverted bucket tappet along a path different from that followed by the downwardly moving arm portion 114 of each of the actuators 106 and 108, while it also rotates in relation to the socket member 138.

A somewhat different movement of each of the actuators 110 and 112 occurs when the lift portion of the cam lobe 166 causes downward movement of the tail end of the rocker arm 68 to open the intake valves 28 and 30 against the bias of the associated springs 94. In this regard, it will first be noted that sliding movement of the two spherical joints 148 relative to the flat top surfaces 118 of the actuators 110 and 112 occurs similar to that as explained above in connection with the rocker arms 66 and 70 and the actuators 106 and 108. In this instance, however, inasmuch as the longitudinal center axis of each arm portion 114 of each of the actuators 110 and 112 moves downwardly along a plane which passes through the longitudinal center axis of the valve stem 36 of the associated intake valve and axis "A", neither of the actuators 106 or 108 experience pivoting about their guide pin 120. The tongue 124 of the half-ball member 122 associated with each the actuators 110 and 112, however, experiences a sliding movement within the accommodating slot 134 towards the guide pin 120 of the associated actuator. In addition, the half-ball member 122 within the spherical recess 136 of each inverted bucket tappets 62 and 64 compensates for the different angle of motion of the actuator and the tappet. The actuators 110 and 112 move in a vertical plane while the tappet moves in a radial plane, that is, a combination of longitudinal and transversal planes. From a practical standpoint, the spherical joint allows simple and inexpensive manufacture of interchangeable parts which are not position-sensitive. In other words, the identical inverted bucket tappets 58–64, half-balls 122, socket members 138, and actuators can be installed in combination with any of the tappet guides 90, 92, 102, 104 at random, without matching. Furthermore, the ball and socket mechanisms also allow free rotation of the tappets 58–64 and sockets 138 about their own axis to minimize wear.

With reference to FIG. 3, it will be noted that, if desired, one could reposition the guide pins 120 of the actuators 110 and 112 so they are located closer to the guide pins 120 of the adjacent actuators 106 and 108. If this were done, the center of each guide pin of the actuators 110 and 112 would no longer be in the aforementioned plane passing through the longitudinal center axis of the valve stem of the intake valve and the axis "A". As a consequence, each actuator 110 and 112 would experience a similar compound movement as enjoyed by the actuators 106 and 108 associated with the exhaust valves 32 and 34. Namely, a downward movement along the associated guide pin 120 and the pivoting about the guide pin 120 as the actuators 110 and 112 are being depressed by the rocker arm 68. Accordingly, it should be apparent that the different arrangements and positions of the guide pins 120 provide different degrees of oscillation of the actuators and sliding of the half-ball at the end of the actuator arm portions. With the arrangement typically shown for actuation of the exhaust valves, the actuator will have the maximum range of oscillation, but the half-ball at its end will have the minimum amount of sliding motion. With the arrangement as shown for the intake valves, there would be no oscillation, but the sliding movement would be at its maximum.

As should be apparent from the above description, this invention provides a new and improved actuator system and, in effect, provides a new valve train mechanism. Moreover, as disclosed in the accompanying drawings (the cross sections and isometric views of which were taken from true engineering drawings), the valve train mechanism shown is incorporated in a rather small diesel engine of 98.4 mm bore diameter. In this regard, it will be noted that in spite of the use of radial valves and their larger spread between the valve stem tips, the width of the cylinder head is quite acceptable. In addition, the design of the cylinder head satisfies the requirements for short rocker arms with low mass and a very compact, light and narrow cylinder head while allowing high-flow radial valves, placed side-by-side with efficient intake and exhaust ports.

Various changes and modifications can be made to the above-described valve train mechanism and the actuator system without departing from the spirit of the invention. For example, although the center of the guide pin 120 of each actuator 106, as seen in FIG. 3, is described as being located along the line interconnecting the centers of the half-ball members 122 associated with the actuators 106 and 110, it will be understood that the center of such guide pin 120 could be moved slightly to one side or the other of such line (as could be required by packaging considerations) without effecting the operation of the valve train mechanism 14. The same applies to the location of the center of the guide pin 120 of the actuator 108. Accordingly, such changes and modifications are contemplated by the inventor and he does not wish to be limited except by the scope of the appended claims.

The embodiments of the invention in which an exclusive property or privilege is claimed are defined as follows:

1. A valve train mechanism for an internal combustion engine having a cylinder head fixedly mounted on an engine block provided with one or more cylinders each of which has a piston reciprocally supported therein along the axial center line of the associated cylinder, a combustion chamber in each of said cylinders of said engine being defined by a recess in the base of said cylinder head and the top of said piston, an exhaust valve and an air intake valve located in said cylinder head, each of said valves being biased into a closed position by a spring and being inclined outwardly from said combustion chamber relative to said axial center line, a first rocker arm and a first actuator for moving said exhaust valve to an open position against the bias of the associated spring, a second rocker arm and a second actuator for moving said intake valve to the open position against the bias of the associated spring, said first rocker arm and said second rocker arm each being supported by said cylinder head for pivotal movement along an axis normal to said axial center line, each of said first and second actuators having the configuration of an inverted "L" and comprising a leg portion integrally formed with an arm portion, a first guide pin fixed to said cylinder head between said intake valve and said exhaust valve for supporting said leg portion of said first actuator, a second guide pin fixed to said cylinder head between said axial center line of said cylinder and the longitudinal center axis of one of said valves for supporting said leg portion of said second actuator, a first ball and socket connection located between said arm portion of said first actuator and one of said valves, a first sliding connection between said one of said valves and said first actuator for cooperation with first ball and socket connection so as to permit said first actuator to reciprocate along and oscillate about the first guide pin while said one of said valves is moved between said closed position and said open position, a second ball and socket connection located between said arm portion of said second actuator and the other of said valves, and a second sliding connection between said other of said valves and said second actuator for cooperation with said second ball and socket connection so as to permit said second actuator to reciprocate only along said second guide pin while said other of said valves is moved between said closed position and said open position.

2. A valve train mechanism for an internal combustion engine having a cylinder head fixedly mounted on an engine block provided with one or more cylinders each of which has a piston reciprocally supported therein along the axial center line of the associated cylinder, a combustion chamber in each of said cylinders of said engine being defined by a recess in the lower base portion of said cylinder head and the top of said piston, an exhaust valve and an air intake valve located in said cylinder head, each of said valves being biased into a closed position by a spring and being inclined outwardly from said combustion chamber relative to said axial center line, a first rocker arm and a first actuator for moving one of said valves to an open position against the bias of the associated spring, a second rocker arm and a second actuator for moving the other of said valves to the open position against the bias of the associated spring, said first rocker arm and said second rocker arm each being supported for pivotal movement by said cylinder head along an axis normal to said axial center line of the associated cylinder, each of said first and second actuators having the configuration of an inverted "L" and comprising a leg portion integrally formed with an arm portion, a first guide pin fixed to said cylinder head for supporting said leg portion of said first actuator, a second guide pin fixed to said cylinder head for supporting said leg portion of said second actuator, a first ball and socket connection located between said arm portion of said first actuator and said one of said valves, a first sliding connection between said one of said valves and said first actuator and cooperating with said first ball and socket connection for maintaining a force applying connection with said one of said valves during movement of said one of said valves between said open position and said closed position, a second ball and socket connection located between said arm portion of said second actuator and said other of said valves, a second sliding connection between said other of said valves and said second actuator and cooperating with said second ball and socket connection for maintaining a force applying connection with said other of said valves during movement of said other of said valves between said closed position and said open position, the arrangement being such that at least one of the guide pins of said first and second actuators is fixed to said cylinder head in a position relative to said exhaust valve and said intake valve so as to cause the actuator supported on said one of the guide pins to reciprocate along and oscillate about said one of the guide pins while the valve operated by said actuator supported on said one of the guide pins is moving between said open position and said closed position.

3. A valve train mechanism for an internal combustion engine having a cylinder head fixedly mounted on an engine block provided with one or more cylinders each of which has a piston reciprocally supported therein along the axial center line of the associated cylinder, a combustion chamber in each of said cylinders of said engine being defined by a recess in the lower base portion of said cylinder head and the top of said piston, an exhaust valve and an air intake valve located in said cylinder head, each of said valves being biased into a closed position by a spring and being inclined outwardly from said combustion chamber relative to said axial center line, a first rocker arm and a first actuator for moving said exhaust valve to an open position against the bias of the associated spring, a second rocker arm and a second actuator for moving said intake valve to the open position against the bias of the associated spring, a shaft mounted in said cylinder head for supporting each of said first and second rocker arms for pivotal movement along an axis normal to said axial center line, each of said first and second actuators having the configuration of an inverted "L" and comprising a leg portion integrally formed with an arm portion, a first guide pin fixed to said cylinder head for supporting said leg portion of said first actuator, a second guide pin fixed to said cylinder head for supporting said leg portion of said second actuator, a first ball and socket connection located between said arm portion of said first actuator and said exhaust valve, a first sliding connection between said exhaust valve and said first actuator and cooperating with first ball and socket connection for maintaining a force-applying connection with said exhaust valve during movement of said exhaust valve between said closed position and said open position, a second ball and socket connection located between said arm portion of said second actuator and said intake valve, and a second sliding connection between said intake valve and said second actuator and cooperating with said second ball and socket connection for maintaining a force-applying connection with said intake valve during movement of said intake valve between said closed position and said open position, the arrangement being such that said first guide pin is fixed to said cylinder head between said exhaust valve and said intake valve so as to cause said first actuator to reciprocate along and oscillate about the first guide pin while said exhaust valve is being moved between said open position and said closed position, and said second guide pin is fixed to said cylinder head between said axial axis of said cylinder and the longitudinal center line of said intake valve so as to cause said second actuator to reciprocate only along said second guide pin while said intake valve is being moved between said open position and said closed position.

4. A valve train mechanism for an internal combustion engine having a cylinder head fixedly mounted on an engine block provided with one or more cylinders each of which has a piston reciprocally supported therein along the axial center line of the associated cylinder, a combustion chamber in each of said cylinders of said engine being defined by a hemispherical recess in the lower base portion of said cylinder head and the top of said piston, a pair of exhaust valves and a pair of air intake valves located in said cylinder head and associated with each cylinder of the engine, each of said valves being biased into a closed position by a spring and being inclined outwardly from said combustion chamber at substantially equi-angular orientation relative to said axial center line of the associated cylinder, a spring biasing each of said valves into a closed position, a first and second rocker arms and first and second actuators for moving said pair of exhaust valves to an open position against the bias of the said spring associated with each of said pair of exhaust valves, a third rocker arm and a third and fourth actuators for moving said intake valves to the open position against the bias of said spring associated with each of said pair of intake valves, a shaft mounted in said cylinder head for supporting each of said rocker arms for pivotal movement along an axis normal to said axial center line of the associated cylinder, each of said actuators having the configuration of an inverted "L" and comprising a leg portion integrally formed with an arm portion, said leg portion of each of said actuators being supported on a guide pin fixed to said cylinder head, a ball and socket connection located between said arm portion of each of said actuators and the associated valve, a sliding connection located between said associated valve and each of said actuators and cooperating with said ball and socket connection for maintaining a force-applying connection with said associated valve during movement of said associated valve between said closed position and said open position, the arrangement being such that said guide pin of each of said first and second actuators is fixed to said cylinder head between one of said pair of exhaust valves and one of said pair of intake valves so as to cause each of said first actuator and said second actuator to reciprocate along and oscillate about its associated guide pin while being moved by said first and second rocker arms, and each of said third and fourth actuators is fixed to said cylinder head between said axial axis of said associated cylinder and the longitudinal center line of one of said pair of intake valves so as to cause said third and fourth actuators to reciprocate only along the associated guide pins while each of said pair of intake valves is being moved between open and closed position by said third rocker arm.

5. The valve train mechanism of claim 4 wherein said pair of exhaust valves and said pair of intake valves are located on opposite sides of a first plane that includes the longitudinal center axis of said cylinder head.

6. The valve train mechanism of claim 5 wherein said guide pin of said first actuator and said guide pin of said second actuator are each located between transversely aligned intake and exhaust valves.

7. The valve train mechanism of claim 6 wherein the longitudinal center axis of said guide pin of said third actuator and the longitudinal center axis of said guide pin of said fourth actuator are each located between said axial center line of the associated cylinder and the longitudinal center axis of one of said pair of intake valves.

8. The valve train mechanism of claim 7 wherein the longitudinal center axis of said guide pin of said first actuator and the longitudinal center axis of said guide pin of said second actuator are located substantially on said first plane.

9. The valve train mechanism of claim 8 wherein the longitudinal center axis of said guide pin of said third actuator and the longitudinal center axis of said guide pin of said fourth actuator are located in a second plane which is parallel to said first plane.

10. The valve train mechanism of claim 9 wherein said third rocker arm is located between said first and second rocker arms.

* * * * *